US005380044A

United States Patent [19]

Aitkens et al.

[11] Patent Number: 5,380,044

[45] Date of Patent: Jan. 10, 1995

[54] IDENTIFICATION CARD AND METHOD OF MAKING SAME

[75] Inventors: Robert K. Aitkens, Cranford, N.J.; Paul F. Gloser, Souderton, Pa.; George F. Keelty, Edison, N.J.

[73] Assignee: K & A Industries, Inc., Bridgewater, N.J.

[21] Appl. No.: 869,731

[22] Filed: Apr. 16, 1992

[51] Int. Cl.[6] ..... B42D 15/00

[52] U.S. Cl. ..... 283/67; 283/70; 283/109; 283/904

[58] Field of Search ..... 283/109, 904, 67, 69, 283/70

[56] References Cited

U.S. PATENT DOCUMENTS 4,313,984 2/1982 Moraw et al. ..... 283/109 X
4,324,421 4/1982 Moraw et al. ..... 283/109 X
4,596,409 6/1986 Holbein et al. ..... 283/094 X
4,687,526 8/1987 Wiffert ..... 283/109 X
4,732,410 3/1988 Holbein et al. ..... 283/904 X
4,928,996 5/1990 Oshikoshi et al. ..... 283/109
4,930,814 6/1990 Nusmeier ..... 283/109

*Primary Examiner*—Paul A. Bell
*Attorney, Agent, or Firm*—Arthur L. Plevy

[57] ABSTRACT

The present invention is a card for displaying information and a method for making the same. The present invention includes printing the desired information in reverse onto a transparent piece of silicon coated vinyl. The vinyl is then fused to a plastic substrate sealing the printed ink between the vinyl and the plastic substrate and allowing the ink to leach into, and permanently mark, the plastic substrate.

9 Claims, 6 Drawing Sheets

IDENTIFICATION CARD AND METHOD OF MAKING SAME

FIELD OF THE INVENTION

The present invention relates to identification cards that display a picture and textual information concerning an individual, as well as the corresponding method for manufacturing the same, and more particularly to such identification cards wherein the picture and text displayed on the card are electronically generated without the use of film photography and wherein the electronic image is printed directly into the plastic material of the card, eliminating the need for a paper based substrate.

BACKGROUND OF THE INVENTION

The use of identification cards (herein ID cards) are now commonplace in many companies, colleges, government agencies and other similar organized groups. The purpose of identification cards is to provide verification as to a person's authority to enter a particular area or to perform certain restricted activities. Most ID cards are formed using photographic technologies, wherein a photograph of a person is attached to a distinctive substrate and sealed between two transparent laminates. For an example of such laminated photograph type of ID cards, see U.S. Pat. No. 4,869,946 to Clay and Canadian Patent No. 981,303 to Mattes. Unfortunately, with the advent of color copying technologies, such photo ID cards are becoming increasingly easy to forge or alter. Consequently, ID cards are loosing their effectiveness in deterring unauthorized activities.

In an effort to make ID cards more difficult to forge, ID cards have become more technically sophisticated. For example, ID cards often include codeable magnetic strips or bar code data that can be read by a scanning device. Such technical devices do help to prevent reproduction, but they do not prevent impostors from using stolen or found cards and it does not stop dishonest people from giving their ID cards to other unauthorized individuals. Despite advances in technology, the most effective manner to ensure that a particular ID card belongs to a specific individual is to have an easily identifiable portrait of the individual on the ID card. With a picture clearly visible on an ID card, the authorization of a person can be quickly verified by a simple glance. However, an ID card, even with magnetic strips or bar code data, is only effective if the picture on the ID card cannot be easily replaced or altered. Otherwise valid ID cards can be misappropriated, substitute pictures can be put in place of the original picture and unauthorized persons have defeated the ID card security system.

In view of this problem, over the years many different types of ID cards have been invented that were intended to prevent the unauthorized reproduction or altering of the ID cards. Some ID cards are produced with sophisticated laminate layers, thereby creating visual effects that cannot be readily copied or altered. Such ID cards are exemplified in U.S. Pat. Nos. 4,662,518 to Borror and 5,011,570 to Ohbayashi. These prior art ID cards may also include infrared transparent layers to further deter forged cards. Unfortunately, such prior art ID cards are complicated to manufacture and therefore are expensive as compared to other available ID cards.

Another approach to creating ID cards that are difficult to forge is by substituting a photographic image of a person with a digitized computer image. Such computer based systems are exemplified in U.S. Pat. Nos. 4,921,278 to Shiang et al, 4,222,622 to Krugle, 4,175,775 to Krugle and European Patent Nos. 084,064A1 to Wallerstorfer and 372,837A2 to Miller. In this prior art, the computer created image can be manipulated in manners that make the image difficult to reproduce. However, the images are usually still produced on paper by a printer and the paper substrate is sealed within transparent laminates. As such, the ID card is still very vulnerable to forgery or tampering.

Yet another approach to preventing the forgery or tampering of an ID card is to mark the plastic material from which the surface of the ID card is made. Such prior art is exemplified in U.S. Pat. No. 4,596,409 to Holbein et al., wherein an plastic identification card is written on by means of a laser. In such an ID card a paper-backed photographic image is sealed within two plastic laminates that cannot be nondestructively removed. Therefore by marking the laminates with a laser, the originality of the ID card is confirmed. However, the use of such ID cards assumes that an unauthorized person cannot recreate the identifying markings formed into the plastic laminates. Since plastic is easily worked, the reproduction of any mark does not present a formidable deterrent.

In view of the problems inherent in the prior art, it is a primary objective of the present invention to create a picture ID card wherein the picture and other identifying indicia are not produced on a paper substrate, but rather are produced directly onto a transparent plastic substrate. The plastic substrate, on which is printed the picture, is then heat bonded to another plastic substrate thereby sealing the picture and other identifying indicia between the bonded plastic substrate layers. The picture and other identifying indicia therefore cannot be accessed because they are not independently formed and any attempt to alter the picture or the corresponding identifying indicia would destroy the integrity of the entire ID card.

SUMMARY OF THE INVENTION

The present invention is a card for displaying information and the method for making the same. In a preferred embodiment the present invention card is formed by printing information, in reverse, directly onto a piece of transparent vinyl. The vinyl, print side down, is then fused to an opaque plastic substrate such that the printed information is now readable and in proper orientation when viewed through the transparent vinyl. The ink used to print the information is thermally sensitive. As such, when the vinyl is fused to the plastic substrate the ink runs and leaches into the plastic substrate, permanently marking the plastic substrate with the ink.

The present invention card is preferably used as an identification card and displays textual information concerning an individual as well as an image of the individual. The image of the individual is created by viewing the individual through a video camera and saving the video image in a central processing unit (C.P.U.). Textual information concerning the individual is also inputted into the C.P.U. through the use of a keyboard or other similar variable input means. Additionally, the signature of the individual may be read into the C.P.U. using an electronic writing tablet or similar device. With all the information desired for the identification card stored within the C.P.U., the layout of the identification card can be dynamically chosen. For example, the size, color and position of the textual information, video image and signature can be manipulated as desired by the operator, thereby creating a desired layout.

Once the desired layout of the identification card is chosen, the C.P.U. is downloaded to an electronic printer loaded with appropriately sized sheets of transparent vinyl. The printer prints the downloaded information onto the transparent vinyl in a reverse orientation using a thermally sensitive ink. The printed vinyl is then removed from the printer and placed over a desired plastic substrate, ink side down. The plastic substrate can be any known card including cards that have magnetic strips, bar codes or internal circuitry forming onto the material of the card. The plastic substrate and printed vinyl are then placed into a heated press. The press is heated to a temperature just below the melting point of the vinyl and plastic substrate, as the vinyl and plastic substrate are pressed together. By forcing the vinyl and plastic substrate together in the heated press, they fuse and the ink, printed on the vinyl, leaches into the plastic substrate permanently marking the plastic substrate.

Normally, ink does not adhere well to vinyl and, once printed, the ink tends to bleed across the vinyl causing printed images to blur. To enhance the printing of ink onto the transparent vinyl, the vinyl is coated with a thin film of silicon, whereby the silicon enhances the application of the ink onto the vinyl. Additionally, the fusion of the vinyl to the plastic substrate encapsulates the ink. As such, the ink does not bleed across the vinyl and the images printed with the ink remain clear.

BRIEF DESCRIPTION OF THE FIGURES

For a better understanding of the present invention, reference is made to the following description of an exemplary embodiment thereof, considered in conjunction with the accompanying drawings, in which.

FIG. *3a* is a video display image of a background screen;

FIG. *3b* is a video display image of an individual positioned in front of the background screen of FIG. *3a;*

Figure 4:
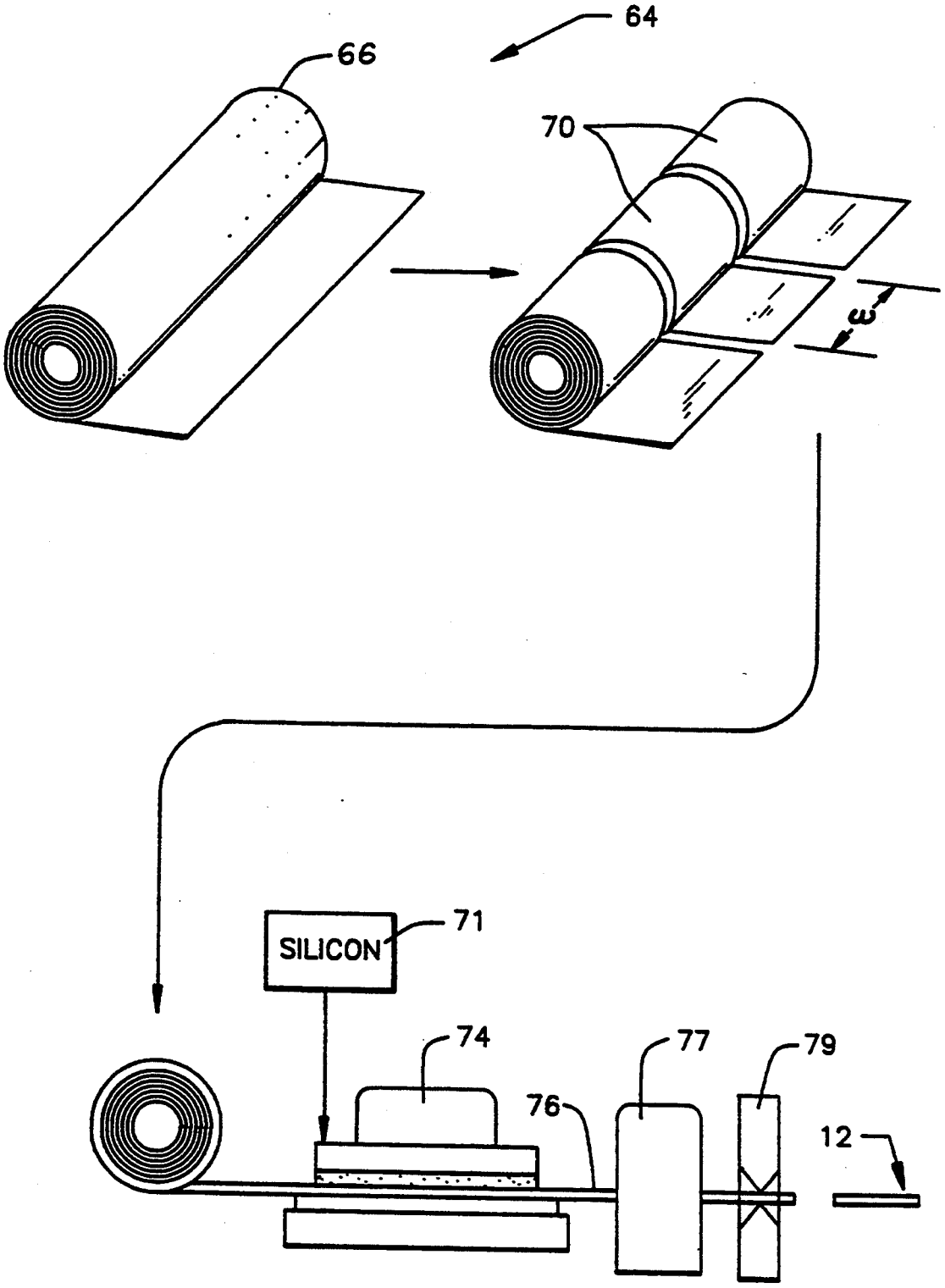
Figure 5:
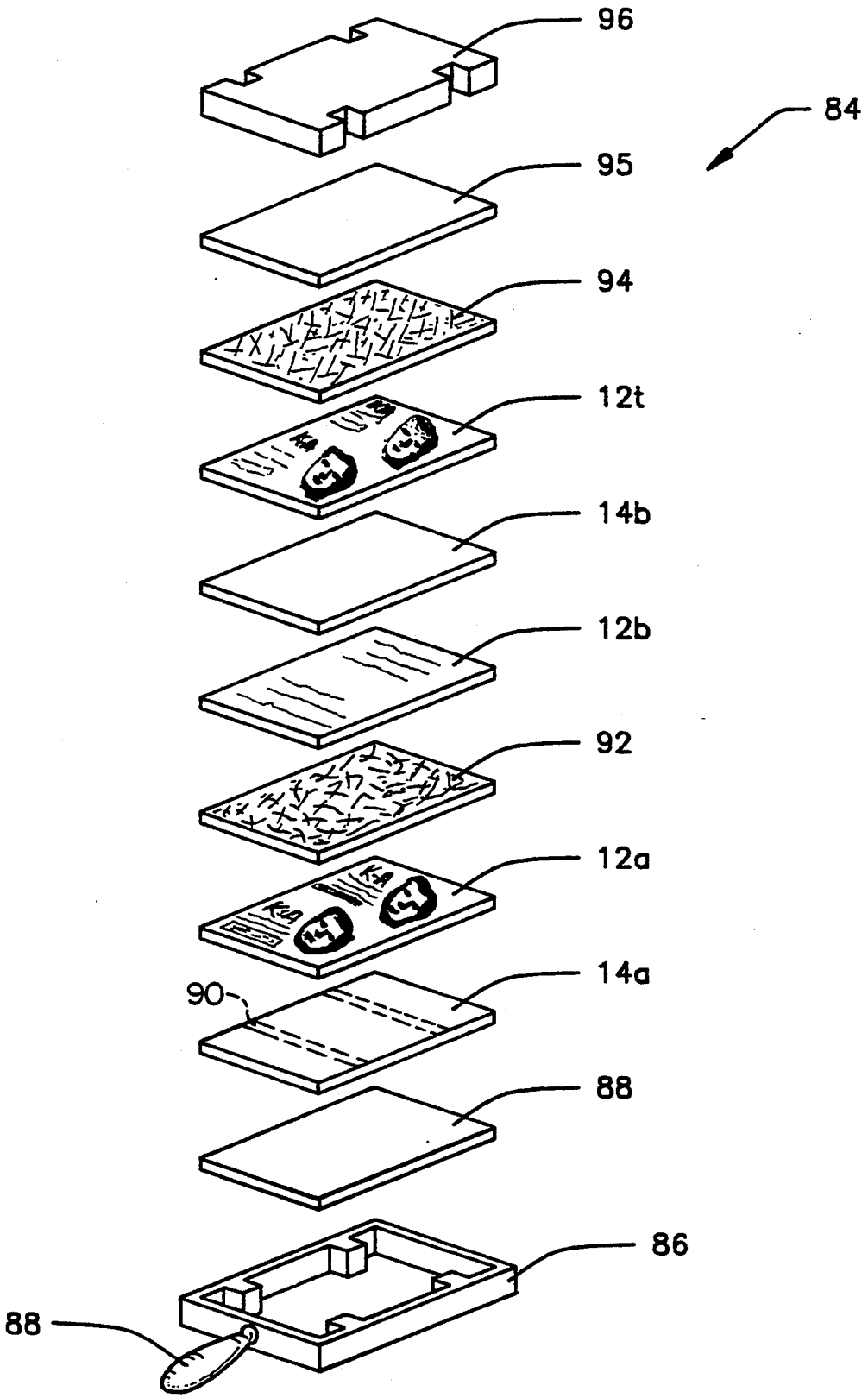
Figure 6:
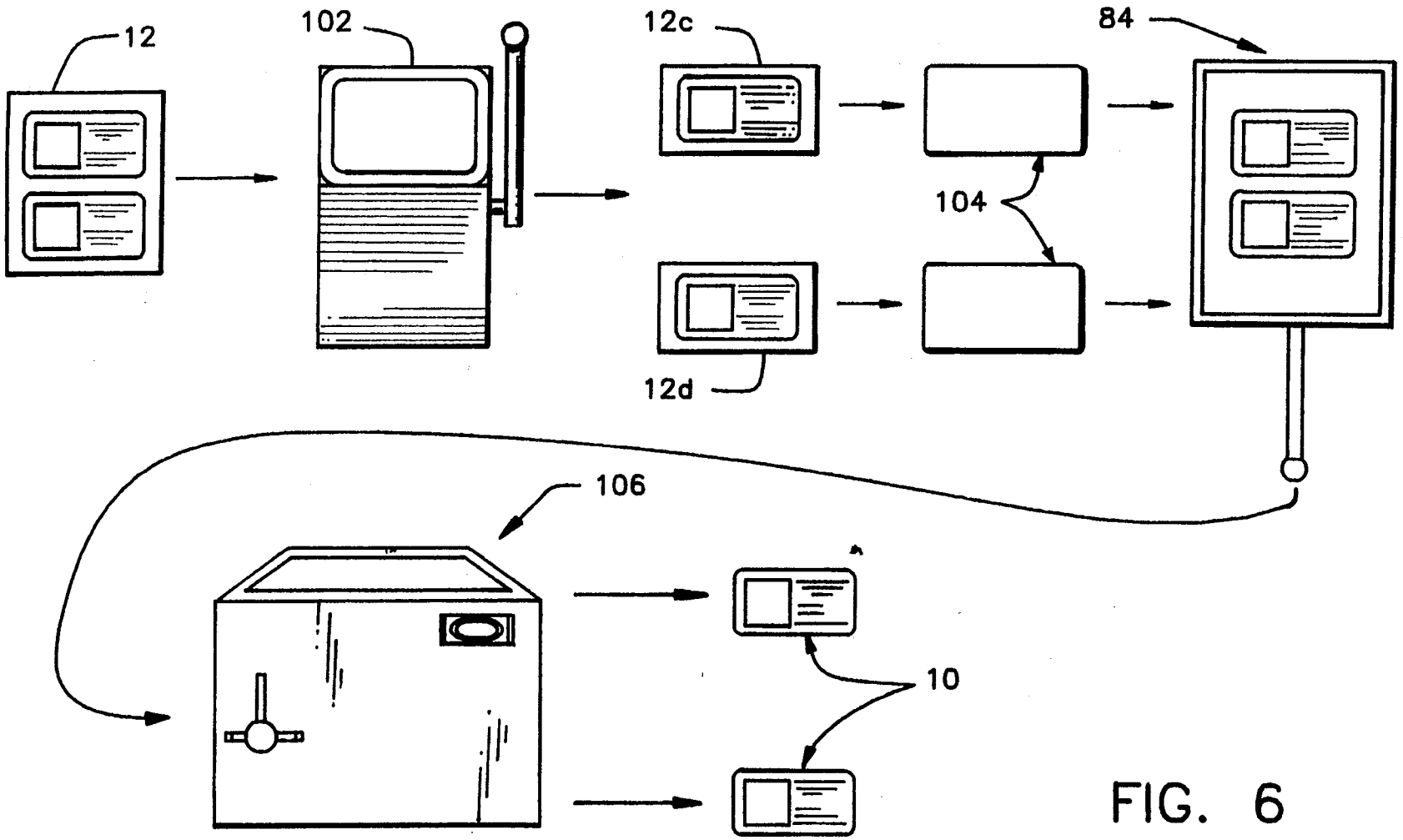

FIG. *3c* is a video display of a silhouette image created by the video image of an individual from the video image of the background screen;

FIG. 4 shows one preferred embodiment for the process of preparing commercially available vinyl material into a form and shape that is adapted for printing;

FIG. 5 shows a preferred embodiment for a jig assembly used to fuse the vinyl laminates onto corresponding plastic substrates; and FIG. 6 shows one preferred embodiment for the process of fusing vinyl laminates to prefabricated card substrates.

DETAILED DESCRIPTION OF THE DRAWINGS

Figure 1:
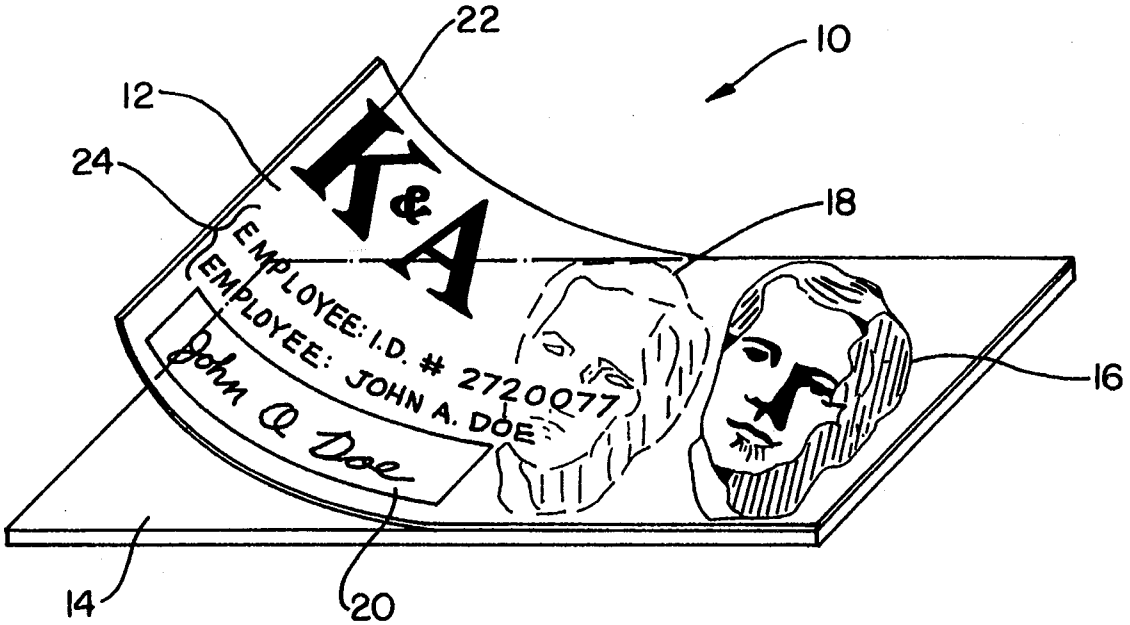
FIG. 1 is a perspective disassembled view of one preferred embodiment of a present invention identification card.

Referring to FIG. 1, a preferred embodiment of the present invention identification card (ID card) 10 is shown. The ID card 10 includes a transparent vinyl laminate 12 heat bonded to an underlying plastic substrate 14. Printed directly onto the vinyl laminate 12, on the surface of the vinyl laminate 12 that is to be fused to the plastic substrate 14, is the information that is to be displayed on the ID card 10. This information may include, but is not limited to, a picture 16 of an individual, an off-set ghost image 18 of the original picture 16, the individual's signature 20, the insignia 22 of the organization issuing the ID card 10 and other relevant text 24, such as employee ID number, social security number, height, weight, etc.

The plastic substrate 14, onto which the vinyl laminate 12 is fused provides the needed rigidity to the ID card 10. The plastic substrate 14 is opaque and may be formed of polyvinyl chloride (PVC) or other thermally sensitive thermoplastic polymer that enables heat bonding with the vinyl laminate 12 at temperatures not destructive to the vinyl laminate 12 or the ink used to create the picture 16 and its accompanying text. The plastic substrate 14 may be custom manufactured for use as part of the present invention or it may be an existing manufactured card. The plastic substrate 14 therefore may be manufactured by any known prior art method of making cards and may include known prior art security devices such as a magnetic strip, bar codes, infrared transparent substrate layers or like devices. If the plastic substrate 14 includes magnet strips, bar codes or other devices that must be on the surface of an ID card to function properly, the vinyl laminate 12 is bonded to the plastic substrate 14 on the side of the plastic substrate 14 opposite the surface device or in areas surrounding the surface device so as not to interfere with the operation of these components. If the plastic substrate 14 includes no such devices, the vinyl laminate 12 may be bonded to either side of the plastic substrate 14 or to both sides of the plastic substrate 14, as desired.

The picture 16, signature 20 and other information printed onto the vinyl laminate 12 is printed onto the vinyl laminate 12 in reverse. As such, the proper image and text can be seen by viewing the picture 16, signature 20 and other printed information through the transparent vinyl laminate 12 from the side that is not printed upon. When the vinyl laminate 12 is heat fused to the plastic substrate 14, the ink used to create the picture 16, signature 20 and other informational text is trapped between the above vinyl laminate 12 and the below plastic substrate 14. The isolation of the ink prevents the ink from running or bleeding through the material of the vinyl laminate 12, thereby eliminating what is commonly called "vinyl bleeding" and ensuring a long lasting ID card 10 with a well defined picture 16, signature 20 and other desired information.

Figure 2:
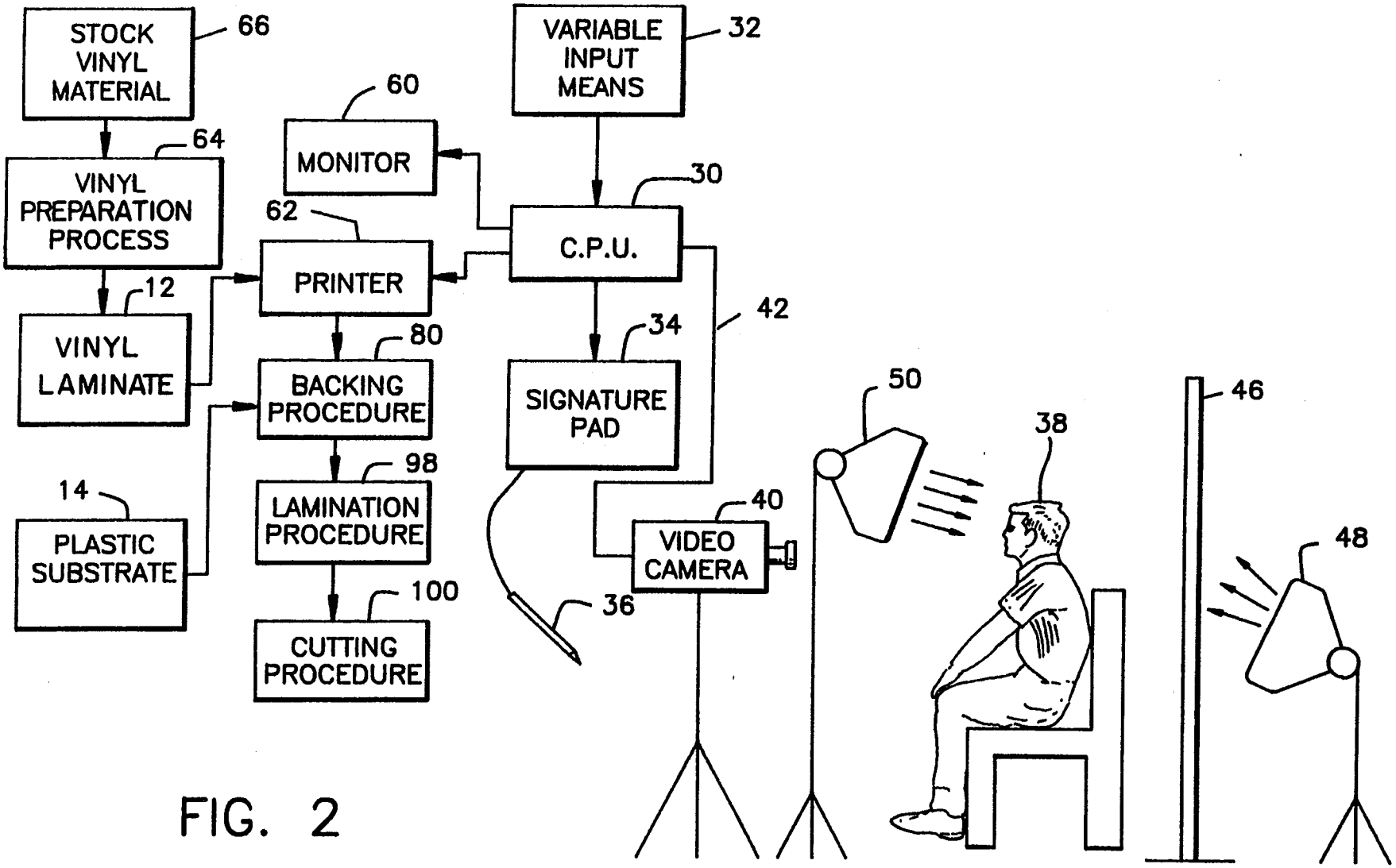
FIG. 2 is a block diagram illustrating a preferred embodiment of the method for producing the present invention identification card.

Referring to FIG. 2, the overall method of manufacturing the present invention ID card 10, of FIG. 1, is illustrated in the form of a block diagram. The first part of creating the present invention ID card 10 is to generate the picture 16, ghost image 18, signature 20, logo 22, and associated text 24 that will appear on the ID card 10. Starting with the textual information, such as the logo 22, and the text 24, this information is entered into a programmable central processing unit (C.P.U.) 30 by the use of a variable input means 32. In the preferred embodiment of the present invention, the C.P.U. 30 is a personal computer and the variable input means 32 is the keyboard of the computer. Using the computer keyboard, the textual information can be entered into the C.P.U. 30 in any desired color, size or font. Additionally, corporate logos or similar graphical designs can be generated within the C.P.U. 30 using known graphics software or it can be read into the C.P.U. 30 through the use of an optical scanner (not shown), from a previously created design.

The signature 20 of an individual is entered into the C.P.U. 30 using an electronic digitizing tablet 34. Digitizing tablets 34 are known devices which allow a person's signature to be read by a computer by having a person reproduce his or her signature on the digitizing tablet 34 with an electronic pen 36.

With the textual information and the signature 20 entered into the C.P.U. 30, only the picture 16 of the individual and optionally the ghost image 18 of the picture 16 need be entered, in order to create the ID card 10. As can be seen from FIG. 2, the picture 16 of an individual 38 is created by seating the individual 38 in front of a video camera 40. The video camera 40 creates a video signal (shown as line 42) corresponding to the viewed image of the individual 38 and reads that video signal 42 into the C.P.U. 30. In the preferred embodiment of the present invention ID card 10, only the features of the individual 38 are printed onto the vinyl laminate 12. The picture 16 printed on the vinyl laminate 12 does not include any background image that surrounds the individual 38. As such, a large image of the individual can be printed onto the ID card without concern of fitting the background into the printed image. As will be described, the C.P.U. 30 separates the background from around the image of the individual 38 before the image of the individual 38 is printed on the vinyl laminate 12.

The first step in removing the background image from the desired image of an individual 38 is accomplished by positioning the individual 38 in front of a single colored semi-translucent background screen 46. On the side of the background screen 46, opposite the individual 38, is a first lighting device 48. The first lighting device 48 is positioned so that the individual 38 lay directly in the path from video camera 40 to the first lighting device 48. The background screen 46 is semi-translucent, as such light from the first lighting device 48 passes through the background screen 46, lighting the back of the individual 38 and enhancing the depth of field on the front of the individual 38, facing the video camera 40. In an alternative embodiment (not shown) the first lighting device 48 can be positioned between the individual 38 and the background screen 46 and directed toward the background screen 46. Such a configuration would cause the background screen 46 to be brightly lit, thereby creating the same depth of field in the front of the individual as would be present in the described preferred embodiment of FIG. 2. A second lighting device 50 is positioned in front of the individual 38, casting light on the individual 38 from substantially the same position as the placement of the video camera 40. The second lighting device 50 is not as bright as the first lighting device 48, as such the second lighting device 50 does not remove depth of field created by the first lighting device 48 in the viewed image of the individual 38. Therefore, there remains a dominant background lighting that prevents the over lighting of the individual's 38 face and allows for the clear definition of the individual's 38 facial features as viewed by the video camera 40.

Figure 3A:
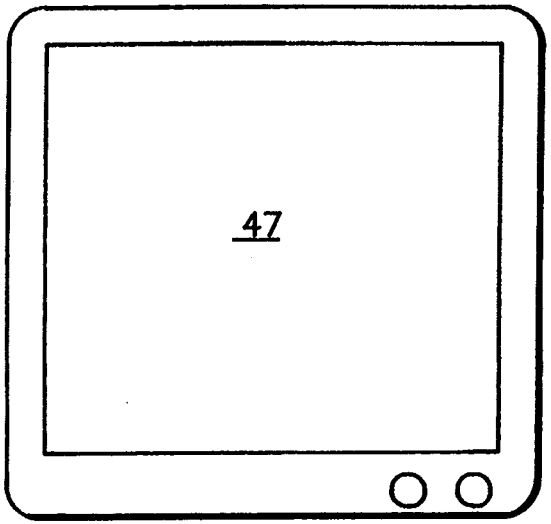
Figure 3B:
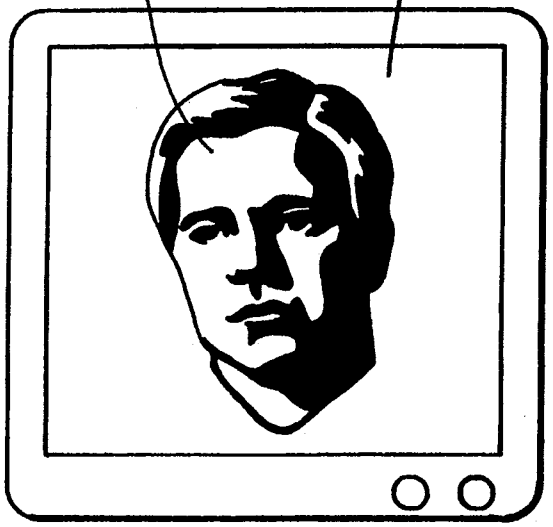
Figure 3C:
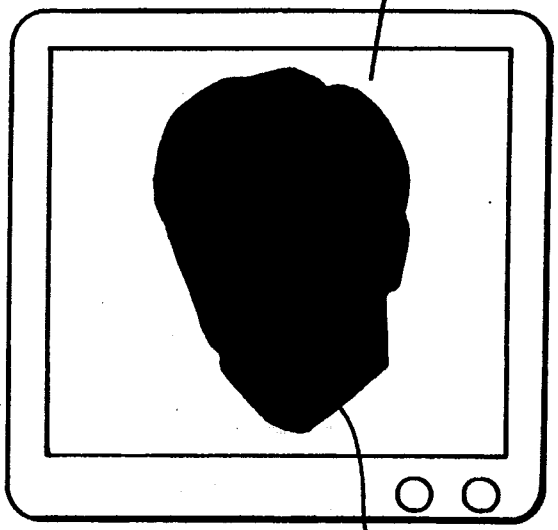

Referring to FIGS. 3*a*–3*c*, in conjunction with FIG. 2, the process of removing the background image from the desired image of the individual can be detailed. First the video camera 40 is operated when no individual is seated in front of the background screen 46. The resulting background image 47 produced by the video camera 40 is that of the plain background screen 46 (see FIG. 3*a*). The background image 47 generated by the video camera 40 for the background screen 46 is read and stored by the C.P.U. 30. Next an individual 38 is positioned in front of the background screen 46 and a portrait image 52 is created by the video camera 40 corresponding to the appearance of the individual 38 in front of the background screen 46 (see FIG. 3*b*). Since the background screen 46 is backlit with the first lighting device 48, the background image 47 of the background screen 46 is the brightest portion of the entire viewed image. The face of the individual 38 is only lit by the second lighting device 50 which is less bright than the first lighting device 48. As such, there can exist no colors on the individual 38 that exactly match the brightness of the background image 47, as perceived by the video camera 40.

Within the C.P.U. 30, a comparator operation is performed wherein the portrait image 52 produced by the individual 38 sitting in front of the background screen 46 (see FIG. 3*b*) is compared to the stored background image 47 of the plain background screen 46 (see FIG. 3*a*). The comparator operation is software driven and reads the color of pixels from the portrait image 52 superimposed in front of the background image 47. The C.P.U. 30 compares the pixel color sequence contained within the stored background image 47 to the portrait image 52 superimposed in front of the background image 47. When a pixel color sequence is found that does not correspond between the two images, the C.P.U. 30 records the coordinate position of the pixel transition and then continues across the pixel line until the originally stored background image pixel color sequence is again encountered. The C.P.U. 30 records the coordinate position of where the background image pixel color sequence again begins and then proceeds to the next pixel line. By recursively comparing each pixel line of the portrait image 52 of the individual 38 to the plain background image 47 and recording the points of a pixel sequence change, a silhouette map 54 corresponding to the portrait image 52 of the individual 38 is formed (see FIG. 3*c*). The image data that falls within the silhouette map 54 is stored within the C.P.U. 30. The image that falls outside the silhouette map 54 is defined within the C.P.U. 30 such that it will not be sent to the printer with the data contained in the silhouette map 54. With the portrait image 54 isolated by the C.P.U. 30, a ghost image of the portrait image 54 can be created by manipulating the data corresponding to the portrait image 54, in manners known in the art of computer imaging.

With the needed textual information inputted via the variable input means 32, the signature information inputted via the signature pad 34 and the picture information inputted via the video camera 40, the C.P.U. 30 now contains all the elements required to produce the desired layout for the present invention ID card 10.

By again referring to FIG. 2, it can be seen that the C.P.U. 30 is coupled to a video monitor 60. The inputted textual information, signature and picture from the C.P.U. 30 is shown on the video monitor 60 in the form of a graphics display. An operator can then manipulate the various images, changing their placement, size, color, etc. to form any desired layout for the ID card 10. The manipulation of graphical images is software controlled using the C.P.U. 30 and the variable input means 32, graphics control software being well known and widely used in the art.

With the desired size, shape, location and color of the picture 16, ghost image 18, signature 20, logo 22 and relevant text 24 chosen, the corresponding data can be output to a printer 62. The printer 62 prints the desired graphics images in reverse onto a sheet of transparent vinyl laminate 12. In the preferred embodiment a Kodak model SV6600 RGB printer is used to produce the needed color images onto the vinyl laminate 12. However, it should be understood that any other known color video printer may also be used. The Kodak model SU6600 RGB printers, like other color video printers, are designed to reproduce images onto paper. When a vinyl laminate 12 is substituted for the standard printer paper, certain adverse effects must be corrected in order to produce a clear image. The first problem incurred when printing ink onto a vinyl laminate 12, is that there occurs an undesired spreading of the ink when the vinyl laminate 12 is fused to the plastic substrate 14. The spreading of the ink, herein called ink gain, is caused primarily by the surface compression between the vinyl laminate 12 and the plastic substrate 14 that occurs during the fusion procedure. The ink gain causes the printed images to saturate and spread, thereby reducing the quality of the images. Typical ink gain caused by the fusing procedure of the present invention is typically on the order of 15% to 20%. As such, when the desired images are printed onto the vinyl laminate 12 the ink is only printed with a 75% to 80% density. Consequently, during the ink gain the printed images remain sharply defined and the ink gain brings the apparent density of the ink back into the 100% range. Additionally, during the ink gain stage, the ink printed onto the vinyl laminate 12 leaches into the below lying plastic substrate 14. The leaching of the ink downward into the plastic substrate enhances the quality of the printed images by giving the printed images a perception of depth. Additionally, the leaching increases the tamper resistive nature of the ID card 10 by permanently marking the plastic laminate 14, thereby rendering it unusable if it were somehow separated from the vinyl laminate 12.

The second problem in utilizing a transparent vinyl laminate 12 in place of paper in a color video printer is that the vinyl laminate 12 is much less porous than paper and therefore does not accept ink as readily as paper. In order to effectively print ink onto the vinyl laminate 12, the vinyl laminate 12 is subjected to a preparation process 64 prior to its introduction into the printer 62. In the preferred embodiment, the vinyl laminate 12 originates from a clear, low static, flexible (3*h*) vinyl stock material that is widely commercially available. The stock vinyl material 66 is commercially available in large rolls (typically 100 pound rolls of 54 inch lengths).

Referring to FIG. 4, in conjunction with FIG. 3, the preparation process 64 is shown that converts the stock vinyl material 66 into the vinyl laminates 12 used by the printer 62. As has been mentioned, the stock vinyl material 66 is purchased in the form of large rolls. In the preparation process 64, the large rolls of stock 66 are cut into smaller rolls 70, wherein each of the smaller rolls 70 has a width W that is equivalent to the paper width for which the printer 62 was designed to operate. For example, if the printer 62 was designed to print on paper that is four inches wide, the large roll of stock material 66 would be cut into smaller rolls 70 each having a width W of four inches. Once cut, each of the smaller rolls 70 is placed through a silicon application procedure wherein a thin film of silicon 71 is applied to one surface of the vinyl material. In a preferred embodiment, the thin film of silicon 76 is applied to the smaller rolls 70 of vinyl material by attaching a silicon impregnated material 72, such as felt, to a vibratory device 74 such as an oscillating sander. The vinyl material is then moved under the vibrating silicon impregnated material 72 and a very thin film of silicon 76 is applied to the vinyl material as the vibrating silicon impregnated material 72 buffs the vinyl material to a glossy finish. Once coated, the vinyl material is passed through a cleaning procedure 77 where the vinyl material is cleaned of debris. The vinyl material is then passed through a cutter 79 where it is cut into lengths that can be used by the printer 62. The cut silicon coated vinyl material is then used as the vinyl laminate 12 onto which the printer 62 prints.

The presence of the silicon on the vinyl laminate 12 allows the ink from the printer 62 to readily adhere to the vinyl laminate 12. Since only one side of the vinyl laminate 12 is coated with silicon, it is very important that the silicon coated side of the vinyl laminate 12 be positioned within the printer 62 so that the printer 62 prints on the silicon coated surface.

Once the desired graphics and text are printed onto the vinyl laminate 12, the vinyl laminate 12 is subjected to a backing procedure 80 wherein the vinyl laminate 12 is positioned atop a desired plastic substrate 14, prior to the heat fusion lamination procedure 98. The placement of the vinyl laminates 12 atop a desired plastic substrate 14 is done as both the vinyl laminate 12 and the plastic substrate 14 are loaded into a jig that is used during the fusion procedure.

Referring to FIG. 5, a preferred embodiment of a jig 84 is shown in which a plurality of previously described vinyl laminates and plastic substrates can be held at one time. Depending upon the size of the ID card to be produced and the size of the vinyl laminate on which the printer 62 can print, it should be understood that it is possible for the printer 62 to print the desired graphic layout of more than one ID card onto each vinyl laminate. The preferred embodiment of the jig 84 includes a jig base 86 made of a highly thermally conductive material and from which a handle 88 extends. Into the jig base 86 is placed a bottom pad 88, formed to be substantially the same size or larger as the vinyl laminate and plastic substrates. The bottom pad 88 is formed of a resilient material so as to evenly distribute a force of compression across the surface area of the vinyl laminates and plastic substrates. As can be seen from FIG. 5, a first plastic substrate 14*a* is placed atop the bottom pad 88. The plastic substrate 14*a* may be any known card substrate. In the embodiment shown, the first substrate includes magnetic strips (shown as hidden lines 90) formed on the side of the plastic substrate 14*a* facing the bottom pad 88. A first vinyl laminate 12*a* is placed over the first plastic substrate 14*a*. The first vinyl laminate 12*a* has had the layout of two ID cards printed on it by the printer 62. The first vinyl laminate 12*a* is placed over the first plastic substrate 14*a*, ink side down, in preparation of the lamination of the first vinyl laminate 12*a* to the first plastic substrate 14*a*, thereby creating two ID cards having information on one side and a magnetic strip on the opposing side.

In the embodiment shown in FIG. 5, a plurality of ID cards are being prepared for heat lamination at the same time. As such, a spacer 92 is placed atop the first vinyl laminate 12*a* and the components of another set of ID cards is placed over the first. If it is desired to have an ID card with information printed on both sides, a bottom vinyl laminate 12*b* can be placed atop the spacer 92. The bottom vinyl laminate 12*b* can be printed upon by the printer 62, and is placed over the spacer 92 such that the ink of the printed information faces the above-placed second plastic laminate 14*b*. A top vinyl laminate 121 is placed over second plastic laminate 14*b*. The top vinyl laminate 12*t* is also printed upon by the printer 62 and is placed over the second plastic laminate 14*b*, ink side down. With the second plastic laminate 14*b* being placed between two printed vinyl laminates 12*b*, 12*t*, when fused an ID card with information on both sides will be formed.

With a number of plastic substrates and corresponding vinyl laminates stacked within the jig base 86, a top spacer 94 can be placed atop the last vinyl laminate. The spacers 92, 94 not only separate differing ID cards, the spacers 92, 94 may also control the texture to be formed onto the various vinyl laminates. For example, if the spacers 92, 94 were polished, a glossy finish on the vinyl laminates can be obtained, while the use of a matted finish on the spacers 92, 94 may produce a satin finish. Lastly, a top pad 95 is placed over the last spacer 94 and a jig top plate 96 is placed over the top pad 95. The jig top plate 96 is formed so as to fit into the jig base 86, thereby allowing for the compression of the materials between the jig top plate 96 and the jig base 86.

With the various elements of the ID cards stacked within the jig 84, the laminating procedure 98 is begun by inserting the loaded jig 84 into a heated press (not shown). Once within the press, pressure is applied to the jig base 86 and jig top plate 96 thereby squeezing the various plastic substrates and corresponding vinyl laminates together until substantially all trapped air between the various layers is removed. In addition to pressure, the jig 84 is subjected to heat so as to remove any moisture trapped between the various layers. With the air and moisture removed, additional heat and pressure are added until various vinyl laminates and plastic substrates are brought to a temperature approximately twenty five degrees below the gel point of the vinyl laminate 12. By maintaining this temperature and pressure, good thermal contact between the various layers to be combined is assured. Finally, the temperature and pressure is increased until the vinyl laminate 12 and the plastic substrate 14 reach a gel point just below their melting temperatures. At this pressure and temperature, the molecules of the various vinyl laminates and the plastic substrates become unstable and molecular bond occurs across the boundary between the two surfaces thereby fusing the two materials. In the case of a 3*h* vinyl laminate, fusion can occur at a temperature in excess of 138° C. and a pressure in excess of 250 psi.

Once fusion has occurred between the various vinyl laminates and the plastic substrates, the temperature is lowered to below the gel point of the materials, while the pressure is maintained. By maintaining a constant pressure, the newly formed bonds are allowed to set. Once set, the pressure is removed and vinyl laminates positioned against the various plastic substrates are permanently fused together.

As has been previously mentioned, more than one ID card layout may be printed onto any one vinyl laminate 12. As such, once the vinyl laminate 12 is heat bonded to the plastic substrate 14, the individual ID cards 10 must be cut from the aggregation through a cutting procedure 100. The ID cards can be manually cut by placing the vinyl laminate-plastic substrate aggregation into a cutting device with an appropriately shaped face. Once the various ID cards 10 are cut from the vinyl laminate-plastic substrate aggregation, ID cards 10 are produced that have no paper substrate layer. All the information displayed on the ID cards 10 are printed directly onto the vinyl laminates which are now fused to the plastic substrate. Consequently, any attempt to access the printed information in order to alter it would result in the destruction of the ID card 10.

In the embodiment described in regard to FIG. 5, vinyl laminates 12 were fused to plastic substrates 14 and subsequently cut into the shape of ID cards 10. In an alternative embodiment, it may be desirable to fuse vinyl laminates 12 directly onto premanufactured cards that are already cut into a desired shape. Referring to FIG. 6, such a process is shown. In FIG. 6, a desired ID card layout is printed on various areas of a vinyl laminate 12. The printed vinyl laminate 12 is then passed through a cutter 102 wherein each ID card layout is cut into a desired size. Consequently, smaller vinyl laminates 12*c*, 12*d* are produced from the original larger vinyl laminate 12. Each of the smaller vinyl laminates 12*c*, 12*d* are formed to fit across the surface of a premanufactured card 104.

As has been previously mentioned the premanufactured cards 104 can be any known card, and may contain magnetic stripes, bar codes, or internal circuitry. The premanufactured cards 104 and corresponding vinyl laminates 12*c*, 12*d* are then stacked in the laminating jig 84 in the manner previously described. It should be understood that the jig 84 may contain formed slots (not shown) within its structure that hold the individual premanufactured cards 104 into set positions. With the premanufactured cards 104 and corresponding vinyl laminates 12*c*, 12*d* set into the jig 84, the jig 84 is placed within a heated press 106 and the previously described lamination procedure is preformed. When the fusion of the vinyl laminates 12*c*, 12*d* to the premanufactured cards 104 is complete the finished ID cards 10 are removed from the jig 84.

It should be understood that the embodiments of the present invention, specifically described in conjunction with the figures, were merely exemplary and that a person skilled in the art may make variations and modifications to the shown embodiments without departing from the spirit and scope of the invention. More specifically, it should be recognized by a person skilled in the art that transparent sheets polyvinyl chloride could be substituted in place and stead of the vinyl material used to create the vinyl laminate on which the printer prints. Similarly, any plastic material can be used as the plastic substrate as long as the plastic substrate can be heat bonded to the vinyl laminate. All such variations and modifications are intended to be included within the scope of the invention as defined in the appended claims.

What is claimed is:

1. A method of creating a card for displaying information comprising the steps of:

printing information with a printing agent on a first side of at least one transparent vinyl laminate; and fusing said first side of said at least one transparent vinyl laminate to a plastic substrate, wherein said printing agent becomes encapsulated between said at least one transparent vinyl laminate and said plastic substrate;

wherein said printing agent is printed on said at least one transparent vinyl laminate at a density that is less dense than a desired density and said printing agent spreads to said desired density as said at least one transparent vinyl laminate is fused substrate.

2. The method according to claim 1 wherein the information printed on said at least one transparent vinyl laminate includes at least one image of an individual and wherein said step of printing further includes the steps of:

electronically obtaining said image of said individual using a video camera device;

saving said image in a central processing unit; and downloading said image from said central processing unit to a printer wherein said printer reproduces said image on said first side of said at least one transparent vinyl laminate.

3. The method according to claim 2 wherein said step of electronically obtaining said image of an individual includes:

lighting a background screen with a first lighting source;

viewing said background screen with said video camera thereby creating a background screen image that is saved in said central processing unit;

placing said individual in front of said background screen;

lighting said individual with a second lighting source less bright than said first lighting source such that said background screen is brighter than said individual;

comparing the viewed image of said individual in from of said background screen to said background screen image, creating a silhouette map of said individual; and defining the data contained within said silhouette map, in said central processing unit, as said image of said individual.

4. The method according to claim 2 wherein the information printed on said at least one transparent vinyl laminate includes text regarding said individual and wherein said step of printing further includes the steps of entering said text into said central processing unit and downloading said text from said central processing unit to said printer.

5. The method according to claim 4 wherein the information printed on said at least one transparent vinyl laminate includes a signature from said individual and wherein said step of printing further includes the steps of entering said signature into said central processing unit using an electronic writing means and downloading said signature from said central processing unit to said printer.

6. The method according to claim 1 further including the step of coating said at least one transparent plastic vinyl laminate with silicon prior to said step of printing.

7. The method according to claim 1 wherein said step of fusing includes heating said at least one transparent vinyl laminate and said plastic substrate and compressing said plastic substrate against said first side of said at least one transparent member at a given temperature until fusion occurs.

8. The method according to claim 7 wherein said information is printed on said first side of said at least one transparent vinyl laminate in thermal sensitive ink, and said step of fusing further includes heating said ink causing said ink to leach into said plastic substrate, thereby marking said plastic substrate.

9. The method according to claim 8 wherein said step of fusing further includes:

heating said at least one transparent vinyl laminate and said plastic substrate to a predetermined temperature below that of the melting point of said at least one transparent vinyl laminate:

applying pressure to said at least one transparent vinyl laminate and said plastic substrate to remove any air from therebetween;

increasing the temperature and pressure to a gel point just below the melting points of said at least one transparent vinyl laminate and said plastic substrate such that said at least one transparent vinyl laminate fuses to said plastic substrate;

decreasing the temperature to below said gel point of said at least one transparent vinyl laminate and said plastic substrate such that the material of said transparent vinyl laminate and said plastic substrate set; and decreasing the pressure compressing said at least one transparent vinyl laminate and said plastic substrate to ambient.

* * * * *